United States Patent [19]

Quella et al.

[11] 4,340,817

[45] Jul. 20, 1982

[54] SIGNAL ELEMENT WITHOUT A LAMP

[75] Inventors: Ferdinand Quella, Gauting; Heinz Pape, Munich, both of Fed. Rep. of Germany

[73] Assignee: Siemens Aktiengesellschaft, Berlin & Munich, Fed. Rep. of Germany

[21] Appl. No.: 161,078

[22] Filed: Jun. 19, 1980

[30] Foreign Application Priority Data

Jul. 16, 1979 [DE] Fed. Rep. of Germany ..... 2928700

[51] Int. Cl.[3] ..... F21V 9/16; F21K 2/00

[52] U.S. Cl. ..... 250/458; 250/463; 250/465; 250/483

[58] Field of Search ..... 250/458, 462, 463, 465

[56] References Cited

U.S. PATENT DOCUMENTS

| | | | |
|---|---|---|---|
| 1,420,829 | 6/1922 | Frank | 250/462 |
| 2,032,540 | 3/1936 | LaHodny | 250/466 |
| 2,428,792 | 10/1947 | Evans | 250/463 |
| 3,037,137 | 5/1962 | Motson | 250/458 |
| 3,237,591 | 3/1966 | Pichel | 250/465 |
| 3,484,607 | 12/1969 | McGuire et al. | 250/458 |
| 3,691,985 | 9/1972 | Otterlei | 250/465 |
| 3,764,200 | 10/1973 | Glattli | 250/462 |

*Primary Examiner*—Harold A. Dixon

*Attorney, Agent, or Firm*—Hill, Van Santen, Steadman, Chiara & Simpson

[57] ABSTRACT

A signal element without a lamp for use with signal buttons, toggle switches, control knobs, slide switches and the like which has a moveable member received in the housing member for movement between at least two positions to cause actuation of the part of the element characterized by a fluorescent member consisting of a body of material having an index of refraction >1 and containing fluorescent particles for fluorescently collecting and scattering incident light to create fluorescent light and means for uncoupling concentrated fluorescent light from the fluorescent member to a point of the element in response to a selected position of the moveable member in the housing member. The moveable member may be a push button, a pivotable rocking member or a slide and the fluorescent member may be carried by the moveable member or may be part of the housing, which receives the moveable member.

40 Claims, 14 Drawing Figures

SIGNAL ELEMENT WITHOUT A LAMP

BACKGROUND OF THE INVENTION

The present invention is directed to a signal element without a lamp for use in for example signal buttons, toggle switches, control knobs and slide switches and primarily in conjunction with a symbol. The signal element has a moveable member assuming different positions with respect to a fixed housing member or part during different switching states.

A switch button without a lamp is already known and has switching states which can be easily perceived by means of one or more luminous symbols and which operates without a lamp (see German A.S. No. 2,032,839). This device has one position in which mirrors will reflect the ambient light which is laterally incident on a component of the switch button towards the front. In the other position of the device, no light penetrates into the component to be reflected at the front part thereof.

SUMMARY OF THE INVENTION

The present invention is directed to providing a switching element whose position can be easily perceived by means of one or more luminous symbols and which operates without a lamp. The readability of the signal should be guaranteed over the widest possible range of ambient brightness. In addition, the principle of the invention can be used in simple structures which have a variety of configurations.

To accomplish these tasks, the present invention is directed to an improvement in a signal element without a lamp having a moveable member received in a housing member for movement between at least two positions to cause actuation of parts of the element. The improvement comprises a fluorescent member consisting of a body of material having an index of refraction $>1$ and containing fluorescent particles for fluorescently collecting and scattering incident light to create fluorescent light, and means for uncoupling fluorescent light from the fluorescent member to a point of the element in response to a selected position of the moveable member in the housing member. Instead of utilizing a single fluorescent body as the light collecting device, a plurality of different fluorescent bodies, which have different or various colored light can be utilized.

With the solution according to the present invention, it is possible to illuminate not only a signal button but also switch devices such as toggle switches, control knobs, and slide switches, or the like. The possibility in collecting light, particularly diffused light, as well as concentrating it on specific coupling out areas makes the proposed signal element far superior to a system with mirrors with regard to the scope of its application and makes it close to an active signal display with respect to its readability. The display is easy to read both in twilight as well as in very bright ambient light which does not apply for example with LED's or glow lamps which do not provide this wide of range of application.

According to a further development of the invention, the fluorescent body is integrated in the actuation part of the signal element. Since the actuation part is the moveable part, or member, this has the advantage that the illumination condition can thereafter be changed in a simple manner. In another development, the fluorescent body is part of the housing member, it is possible in this manner to achieve greater collecting surfaces than is possible for example when the fluorescent body is in the moveable part of a standard switch.

According to a further embodiment, the fluorescent light is coupled out of the fluorescent body by utilizing fiber optical waveguides or by using light conductors. This makes it possible to conduct the light without loss over portions of the element which have nothing to do with the light collection.

DESCRIPTION OF THE PREFERRED EMBODIMENTS

Figure 1A:
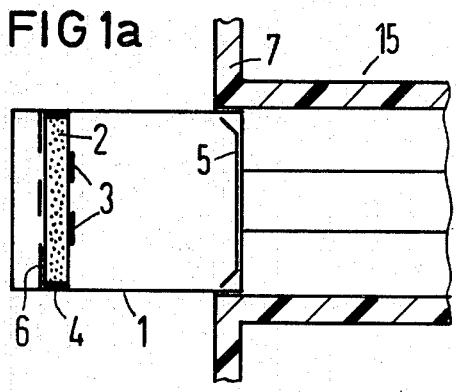
FIGS. 1*a* and 1*b* illustrate two longitudinal cross-sectional views of a signal button according to the invention with FIG. 1*a* being a view with the button in the exposed position, and FIG. 1*b* being a view with the button in a retracted position.
Figure 1B:
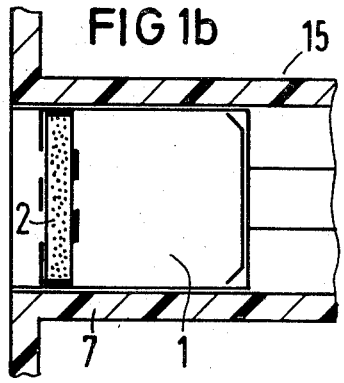
Figure 2:
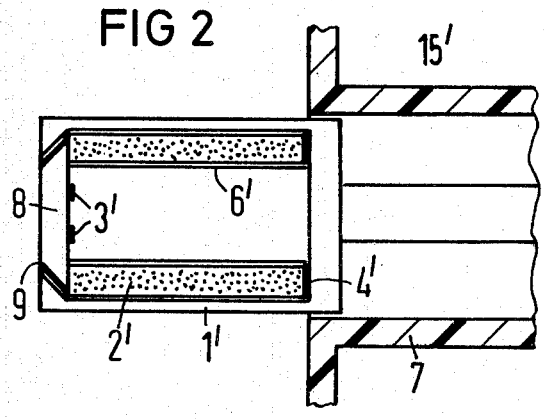
FIG. 2 is a modification of a signal button which is illustrated as being in the extended position as in FIG. 1*a;*

The principles of the present invention are particularly useful when incorporated in a push button switch element generally indicated at 15 in FIGS. 1*a* and 1*b*, or 15' in FIG. 2.

The element of the switch button 15 has a light impermeable housing 7, which slideably receives a light permeable or transparent button 1 attached to a shaft to form a moveable member received in the housing member 7. Associated with the light permeable button is a fluorescent body 2, which has coupling out locations 3 to form means for uncoupling light therefrom. These uncoupling locations 3 may be engraved notches or impressed pigments which are in the form of the desired symbol or letter. The pigments may be white, colored, phosphorescing or fluorescing particles. The fluorescent body 2 may have mirrors or reflective layers such as the mirrors 4 which are applied to the narrow edge to retain the fluorescent light therein. A back wall of the member 1 is provided with a reflector 5, which may be a diffusedly reflective coating to reflect ambient light penetrating into the member 1 onto a back surface of the body 2. The front surface of the body 2 is covered by a light impermeable mask 6, which has openings to uncover portions of the front surface which portions are aligned with the coupling out locations 3.

When the switch or member 1 is in the position illustrated in FIG. 1*a*, the symbols on the member such as "on" or "off" will be illuminated. This is due to ambient light passing through the transparent housing or member 1 and being directed onto the fluorescent body either directly or by a reflection from the mirror 5. The fluorescent body 2 is a plate-shaped body having smooth parallel surfaces and consists of a transparent material with an index of refraction $n>1$ for example a body of polymethyl-methacrylate which contains fluorescent pigments or particles. The fluorescent pigments will convert the ambient light into a fluorescent light, which due to total reflection and reflection on the side reflecting layers or mirrors 4 is for the most part retained within the plate. For example, if the plate has a value of n equal 1.5, approximately 75% of the light will be retained in the plate. This retained light can only leave the plate at the means for uncoupling formed at coupling out locations 3, which can be for example notches or be areas at which pigment has been applied and which will have the shape of the desired symbol to be displayed. Due to the large surface area of the plate 2 relative to the area of the coupling out locations 3, the fluorescent light being uncoupled is concentrated in its intensity.

When the moveable member which is a push button is forced to the second position illustrated in FIG. 1*b*, the member is received in the light impermeable housing 7 so that no ambient light can reach the fluorescent body. Therefore, the display or coupling out locations 3 are not illuminated.

An embodiment of the push button switch 15 of FIG. 1 is illustrated at 15' in FIG. 2. In this embodiment, a light permeable moveable member 1' has a cylindrical shape fluorescent body 2' with the outer cylindrical surface being adjacent to the surface of the member 1'. Contacting one end of the member 2' is a light conductor plate or member 8 which is transparent and is provided with reflectors 9 adjacent the edge of the body 2'. The other cylindrical end of the body 2' is provided with a reflector 4' and the internal surface 6' is provided with a light impermeable shield or coating 6'. Light emitted by the fluorescent plate 2' is conducted via the reflectors 9 into the light conductors 8. The light is emitted at the coupling out locations 3' in the desired pattern of the symbol or character. Ambient light will reach the fluorescent member 2' when the member 1' is in the position illustrated in FIG. 2. However, when the member is depressed or pushed into the housing 7 to a position similar to the position of the member 1 in FIG. 1*b*, then light cannot reach the fluorescent body 2' and the light which penetrates the transparent light conductor 8 is prevented from entering the plate 2' by the shield or coating 6'. The light permeable housing or transparent member 1' can be in the form of translucent glass and thus would serve to protect the fluorescent member 2' from scratching. In principal, however, that moveable member can be formed primarily of the fluorescent body 2' and the conductor 8 with the reflectors 9.

Figure 3:
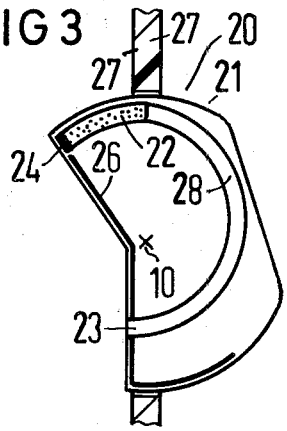
FIG. 3 is a partial cross-sectional view of a flip switch in accordance with the present invention.

Another embodiment of utilizing the present invention is illustrated in a flip switch generally indicated at 20 in FIG. 3. In this arrangement, the flip switch has a moveable member 21, which is mounted for rotational movement about a pivot point 10 on the housing 27. The moveable member 21 is transparent and has a fluorescent body 22 provided with a reflector 24 at one end with the opposite edge or end connected by a light conductor 28 that extends to a coupling out location 23 on the face of the member 21. When the switch is in the position illustrated, light will reach the fluorescent member 22 so that the fluorescent light will be created and will be conducted by the conductor 28 to the point 23 for coupling out. In a second position, with the member 21 being snapped into the housing 27, the covering 26 and the housing 27 coact to prevent entry of light into the transparent member 21 to reach the fluorescent body or member 22. Thus, no light will be uncoupled at the point 23. Any fundamental change of the structure of the invention is possible. For example, it is only necessary that the light entry aperture is respectively open in only one switching state, and that the light entry aperture is closed or covered in the other switching state.

Figure 4A:
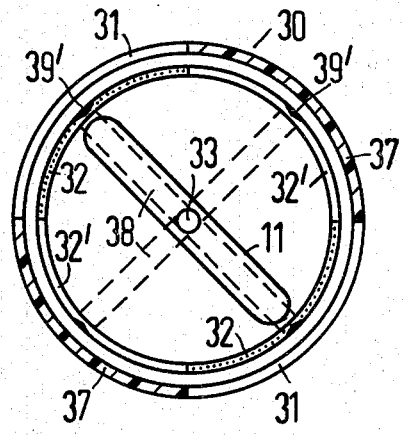
FIGS. 4*a* and 4*b* illustrate a control knob of the present invention with FIG. 4*a* being a cross-sectional plan view with portions in elevation for purposes of illustration and FIG. 4*b* being a cross-sectional side view with portions in elevation and portions broken away for purposes of illustration.
Figure 4B:
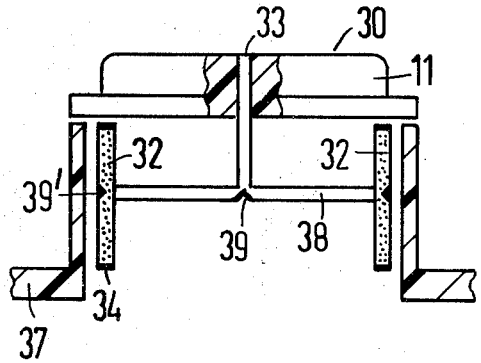

In FIGS. 4*a* and 4*b*, another embodiment of the invention, which is generally indicated at 30, is illustrated. In this embodiment, a housing 37, as best illustrated in FIG. 4*a*, has light impermeable portions and light permeable portions 31. A fluorescent body composed of four segments or portions with portions 32 being opposite each other and having fluorescent particles of one color and the portions 32' being opposite one another between the portions 32 and having a fluorescent particles emitting the fluorescent light of a different color. Both the portions 32 and 32' are connected by light conductors 38 to a coupling out location 33 on a rotational button or knob 11. As best illustrated in FIG. 4*b*, the light conductor 38 is provided with a reflector 39 to reflect the light in the horizontal portions into the vertical portions and each of the partially cylindrical or arcuate shaped fluorescent bodies 32 and 32' have a reflective notch such as 39' to reflect light into the light conductor 38. As illustrated, rotation of the button or member 11 by 90° will move the fluorescent bodies 32 from behind the light impermeable portion 37 where they cannot be reached by ambient light to a light permeable portion 31 which actually may be a transparent material or merely an aperture in the material forming the portion 37. When the body 32 is at the light permeable portion 31, one color of fluorescent light will be conducted to the coupling out region or part 33. When the body 32' is positioned at the permeable portion, a different color can now be created or carried by the light conductor 38 to the coupling out region 33.

While each of the member 32 and 32' are approximately 90° segments, the number and size can be changed. Also more than two different colors for the fluorescent bodies or members can be selected.

Figure 5:
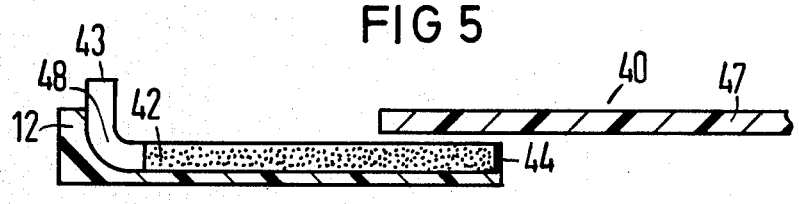
FIG. 5 is a cross-sectional view of a slide switch in accordance with the present invention.
Figure 6:
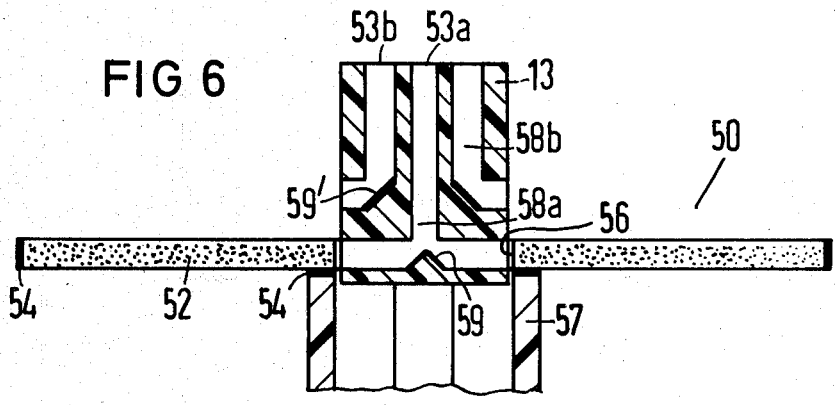
FIG. 6 is a cross-sectional view of a push button which has the fluorescent body as part of the housing in accordance with the present invention.

The principles of the present invention can be used in a slide switch which is generally indicated at 40 in FIG. 5. The slide switch 40 has a slide 12 which carries a plate-like fluorescent body 42 having its edges covered by a reflective layer or coating 44 with one edge in communication with a light conducting waveguide 48 that extends to a coupling out location 43. In a position illustrated in FIG. 5, the fluorescent material of the plate 42 is receiving and trapping ambient light to create a bright illumination at the coupling out location 43. By moving the slide 12, to the right so that the fluorescent member is covered by the light impermeable housing wall 47, ambient light cannot reach the fluorescent body and therefore the coupling out location or point 43 will become dark.

Another embodiment of the present invention is generally indicated at 50 and is a push button switch which has a plurality of positions, for example three positions. A fluorescent body 52 forms part of the housing member. As illustrated, the member 52 is provided with peripheral reflective edge coverings 54 and rests on a housing member 57 which has reflective layers 54'. The moveable member 13 is a light impermeable member having two sets of light conductors 58*a* and 58*b*. As illustrated, the light conductor 58*a* has a reflector 59 and terminates in a coupling out surface or point 53*a* and the light conductor 58*b* has a reflector 59' and terminates in coupling out location or face 53*b*. The moveable member 13 moves through an aperture 56 in the fluorescent plate 52.

As illustrated the member 13 is in a flat axial position with the light conductor 58*a* being aligned in optical communication with the edge of the aperture 56 so that light is coupled out of the portion 53*a*. By depressing the button or member 13, to move in an axial direction to the next position, conductor 58*b* is in communication with the plate 52 to conduct the fluorescent light to the coupling out locations 53*b*. Further depression of the member 13 causes complete isolation of the fluorescent light with none of it reaching either of the coupling out locations such as 53*a* or 53*b*. It should be noted that the light conductors such as 58*a* may have a flange with a peripheral surface so that the entire periphery of the aperture 56 is in communication therewith. In a similar manner, the light conductor 58*b* is a cylindrical member having a ringshaped coupling out location 53*b* and has a flange-like portion with a peripheral edge in complete communication with the entire periphery of the aperture 56 of the plate 52.

Figure 7A:
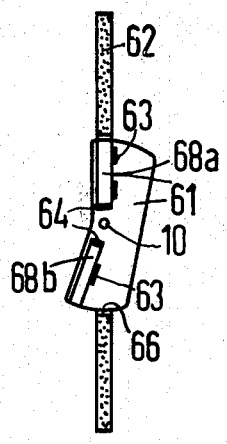
FIGS. 7*a* and 7*b* are views of an embodiment of a flip switch in accordance with the present invention with FIG. 7*a* being a cross-sectional view with portions in elevation for purposes of illustration and FIG. 7*b* being a plan view of the switch of FIG. 7*a;*
Figure 7B:
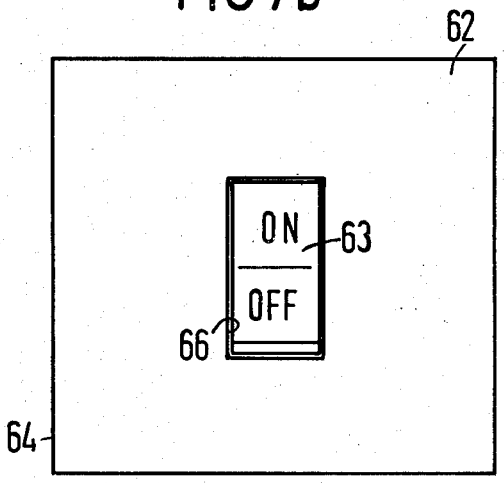

Another embodiment of the present invention is a flip switch generally indicated at 60 in FIGS. 7*a* and 7*b*. As illustrated the fluorescent body 62 forms a cover plate having an aperture 66 for receiving the moveable member 61 of the flip switch 60. The moveable member 61 pivots in the aperture 66 of the plate 62 on a pivot point 10'. As illustrated, the moveable member 61 has a pair of light conductors 68*a* and 68*b*. As illustrated, the conductor 68*a* has its edges aligned with the edges of the aperture 66 so that light in the plate 62 will be conducted therein and coupled out by notches or pigment patterns forming the coupling out locations 63 with a symbol "on". By pivoting the switch on the pivot point 10' so that the member 68*b* has its edges aligned with the edges of the aperture 66, the conductor 68*a* is moved out of communication with the plate 62 and the conductor 68*b* is moved into communication so that the coupling out locations 63', which forms the symbol "off" is illuminated. In both cases, the conductors 68*a* and 68*b* are provided with mirrored edges 64' in the desired location such as the edges shown.

Figure 8A:
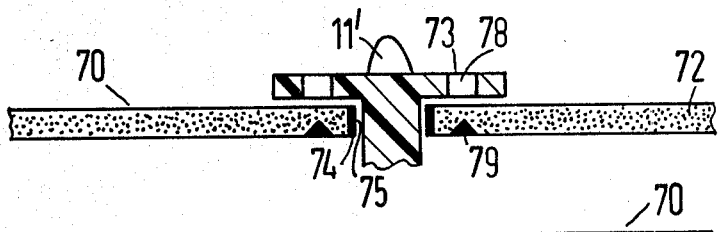
FIGS. 8*a* and 8*b* illustrate a rotary switch in accordance with the present invention with FIG. 8*a* being a cross-sectional view of the rotary switch and FIG. 8*b* being a plan view of the switch.
Figure 8B:
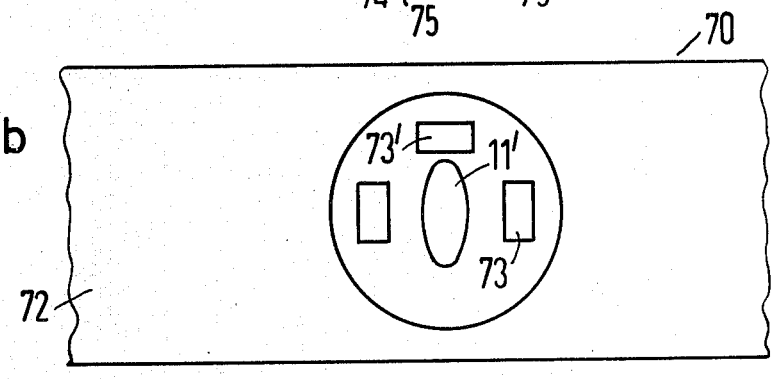

An embodiment of this device is generally indicated at 70 in FIGS. 8*a* and 8*b* in this device, a rotary knob 11' has a portion extending through an aperture 75 of a fluorescent body or plate 72. The aperture is provided with a mirrored or reflective layer 74 and adjacent to the aperture, the plate 72 has a reflective notch or exit window 79. The knob 11' which could be for a rotary switch has a plurality of light conductors 78 which extend through the light impervious body of the knob and terminate in a coupling out location 73. Depending on the rotary position of the rotary member 11', the coupling out point 73 may be illuminated instead of the coupling out point 73' but a rotation of the knob 11' by 90° would then place the coupling out point 73' in an illuminated area while 73 would be darkened.

Figure 9A:
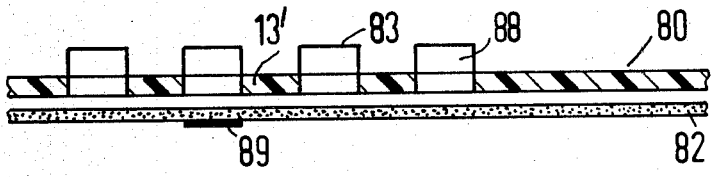
FIGS. 9*a* and 9*b* illustrate a slide switch in accordance with the present invention with FIG. 9*a* being a cross-sectional view taken along lines IX—IX of FIG. 9*b* which is a plan view of the switch.
Figure 9B:
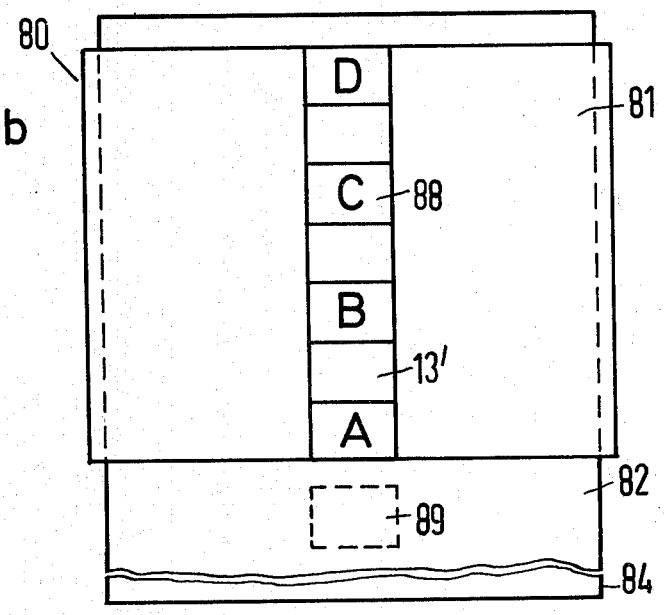

Another embodiment of the invention is a slide switch generally indicated at 80 in FIGS. 9*a* and 9*b*. In this embodiment, a fluorescent plate 82 is provided with means for coupling out formed by a diffuse reflector 89. The moveable body 81 has a strip 13' of light impermeable material which has a plurality of light conductors 88 which, as illustrated in FIG. 9*b*, are in a line and are identified as A, B, C, and D to indicate four switch positions. The rest of the moveable member 81 is of a light permeable or transparent material so that light can pass therethrough and enter the fluorescent plate 82. As the member 81 is moved in a sliding manner, different light conductors 88 are superimposed above the coupling out position 89 so that each one of the position indicators A, B, C and D are separately illuminated with the remaining indicators being darkened depending on the location and the particular switching state for the moveable body 81.

Although various minor modifications may be suggested by those versed in the art, it should be understood that we wish to embody within the scope of the patent granted hereon, all such modifications as reasonably and properly come within the scope of our contribution to the art.

We claim:

1. In a signal element without a lamp having a moveable member received in a housing member for movement between at least two positions to cause actuation of parts of said element, the improvement comprising one of said housing and moveable members including a fluorescent member consisting of a body of material having an index of refraction $>1$ and containing fluorescent particles for fluorescently collecting and scattering incident light to create fluorescent light, and means for uncoupling concentrated fluorescent light from the fluorescent member to a point of the element in response to a selected position of the moveable member in the housing member.

2. In a signal element according to claim 1, wherein at least one of said members such as the fluorescent member has surfaces, which are not totally reflecting, and which it is undesired to have light coupled therefrom, said surfaces being provided with a reflector selected from a group consisting of dielectric reflectors, metallic reflectors and diffused reflectors in optical contact with the surface.

3. In a signal element according to claim 1, wherein surfaces of at least one of the members such as the fluorescent member are not totally reflective of the fluorescent light and coupling on of the fluorescent light thereat is undesired, said surfaces being provided with a reflector spaced from the surface by a layer of material having an index of refraction less than that of the fluorescent member and having a thickness of 0–100 $\mu$m.

4. In a signal element according to claim 1, wherein the means for uncoupling includes utilizing unmirrored surfaces of one of said members.

5. In a signal element according to claim 1, wherein the means for uncoupling utilizes mirrored notches being provided in one of said members.

6. In a signal element according to claim 1, wherein the means for uncoupling utilizes roughened surfaces provided on one of said members.

7. In a signal element according to claim 1, wherein the means for uncoupling utilizes pigments applied to a surface of the fluorescent member, said pigment having a color.

8. A signal element according to claim 1, wherein the means for uncoupling comprises providing pigments selected from a group consisting of fluorescent and phosphorescent pigments applied on one of said members.

9. In a signal element according to claim 1, wherein the means for uncoupling out includes providing scatterers or reflectors integral in one of said members, said scatterers and reflectors being selected from a group consisting of colored fluorescent scatterers or reflectors and phosphorescing scatterers or reflectors.

10. In a signal element according to claim 1, wherein the means for uncoupling includes utilizing mechanical scatterers or reflectors impressed onto one of said members.

11. In a signal element according to claim 1, wherein the means for uncoupling has locations in the form of symbols.

12. In a signal element according to claim 1, wherein the fluorescent member is part of the housing member.

13. In a signal element according to claim 12, wherein the housing member is composed of light transmissive material and said fluorescent member is built into the housing member.

14. In a signal element according to claim 1, wherein means for the uncoupling includes coloring the coupling out locations to promote color contrast.

15. In a signal element according to claim 1, wherein the uncoupling means includes symbols composed of a group consisting of colored symbols and fluorescing symbols disposed on one of said members in optical communication with the fluorescent light from the fluorescent member to produce symbols during coupling out of the fluorescent light.

16. In a signal element without a lamp having a moveable member received in a housing member for movement between at least two positions to cause actuation of parts of said element, the improvement comprising a fluorescent member consisting of a body of material having an index of refraction $>1$ and containing fluorescent particles for fluorescently collecting and scattering incident light to create fluorescent light, said fluorescent member being integral with the moveable member of the signal element, and means for uncoupling concentrated fluorescent light from the fluorescent member to a point of the element in response to a selected position of the moveable member in the housing member.

17. In a signal element according to claim 16, wherein the moveable member, which receives the fluorescent member, consists of a light permeable member, and the housing member is composed of a material impermeable at least for the excitation light of the fluorescent material of the fluorescent member.

18. In a signal element according to claim 17, wherein the fluorescent member on a front face is provided with a covering of material impermeable to the excitation light except in areas for coupling light therefrom.

19. In a signal element according to claim 17, wherein the moveable member with the fluorescent member in at least one position extends out of the housing member so that the fluorescent member can be reached by ambient light.

20. In a signal element according to claim 19, wherein the moveable member on a back surface is provided with a reflective layer so that ambient light penetrating through said moveable member is reflected onto the fluorescent member carried thereby.

21. In a signal element according to claim 20, wherein the fluorescent member on a front surface is provided with a covering impermeable to the output light, said means for uncoupling includes providing locations on a front surface of the fluorescent member free of said covering.

22. In a signal element according to claim 19, wherein the moveable member has one position in said housing member at a depth so that at said one position no ambient light can penetrate through the transparent side walls into the housing to reach the fluorescent member.

23. In a signal element according to claim 16, wherein the fluorescent body lies on the inside of the moveable member directly behind a transparent side wall thereof.

24. In a signal element according to claim 23, wherein the means for uncoupling include coupling out locations adjacent a front surface of the transparent side wall of the moveable member and includes reflectors for directing fluorescent light from said fluorescent member at said coupling out locations.

25. In a signal element according to claim 24, wherein the moveable member includes a clear, light conducting plate at a front surface thereof, said light conducting plate on a rear surface being provided with said coupling out zones and on edges being provided with said reflectors, said fluorescent member being of a cylindrical configuration with an outer surface adjacent an outer cylindrical surface of the moveable member, said cylindrical fluorescent member having an edge in contact with the light conducting plate for coupling light thereto and said cylindrical fluorescent member having an inner cylindrical surface covered by a light impermeable covering to prevent light entering through the front plate from penetrating into said fluorescent member.

26. In a signal element according to claim 16, wherein the means for uncoupling include a light conductor in contact with the fluorescent member, said fluorescent member and light conductor being carried by the moveable member and forming a portion of the actuation part of the element.

27. In a signal element according to claim 16, wherein the moveable member is pivoted on the housing member from a position with the fluorescent material exposed to ambient light to a position with the fluorescent material withdrawn from the ambient light, said means for uncoupling including a light conductor extending from a surface of the fluorescent member to a surface of the moveable member for conducting fluorescent light thereto.

28. In a signal element according to claim 16, wherein the means for uncoupling includes a light conductor in contact with the fluorescent member for uncoupling fluorescent light from said element.

29. In a signal element without a lamp having a moveable member received in a housing member for movement between at least two positions to cause actuation of parts of said elements, the improvement comprising the moveable member rotating in a housing member having light impermeable portions and light permeable portions, a fluorescent member consisting of a body of material having an index of refraction $>1$ and containing fluorescent particles for fluorescently collecting and scattering incident light to create fluorescent light, said fluorescent member including at least one curved member carried by the moveable member for rotation between a position adjacent a light impermeable portion of the housing member and a light transmitting portion, and means for uncoupling concentrated fluorescent light from the fluorescent member and directing the fluorescent light to a coupling out point on the moveable member in response to a selected position of the moveable member in the housing member.

30. In a signal element according to claim 29, which includes at least two fluorescent members having different fluorescent materials to create different fluorescent lights, said means for uncoupling including a light conductor connected to each of said fluorescent members for conducting light to said coupling out point of the rotatable member so that rotation of the member produces indication of one color of light and then rotation to a second position produces an indication of a second color.

31. In a signal element without a lamp having a moveable member received in a housing member for movement between at least two positions to cause actuation of parts of said element, the improvement comprising a fluorescent member consisting of a body of material having an index of refraction $>1$ and containing fluorescent particles for fluorescently collecting and scattering incident light to create fluorescent light, said fluorescent member being a part of the housing member and forming a part of an outer surface of the housing member, and means for uncoupling concentrated fluorescent light from the fluorescent member to a point of the element in response to a selected position of the moveable member in the housing member.

32. In a signal element according to claim 31, wherein the means for uncoupling includes at least one light conducting element carried on the moveable member coacting with the edge of the fluorescent member to uncouple light therefrom.

33. In a signal element according to claim 32, wherein the moveable member is of a light impermeable material and the position of the moveable member in said housing determines whether any of the light conducting members carried thereby are in communication with the fluorescent member.

34. In a signal element according to claim 32, wherein the moveable member has at least two separate light conducting members and the position of the moveable member in the housing determines which of the light conducting members is in communication with said fluorescent member.

35. In a signal element according to claim 34, wherein said moveable member pivots between two positions in said housing member, said moveable member having a first and second light conducting members, each of said light conducting members being provided with means causing uncoupling of light so that pivotable movement to one position has only the first member in communication with the fluorescent member and pivotable movement to the second position has the second member in communication with the first member being out of communication.

36. A signal element according to claim 34, wherein the moveable member slide axially through an aperture in the fluorescent member, said moveable member having at least two light conductors axially spaced thereon so that one position has a first of the light conductors in communication with the fluorescent member and a second depressed axial position has the second member in communication with the first member being out of communication.

37. In a signal element according to claim 31, wherein the means for uncoupling includes means associated with the fluorescent member for reflecting light from a given position there of and light conducting member carried by said moveable members, said moveable member being impervious so that movement to a first position has one of said light conductors aligned with the means for reflecting and movement of the moveable member to a second position aligns a second light conductor with the means for reflecting.

38. In a signal element according to claim 37, wherein the moveable member rotates and said light conducting elements are arranged on a given radius thereof.

39. In a signal element according to claim 37, wherein said moveable member moves in a linear path and said light conducting elements are aligned along the linear path to move over said means for reflecting.

40. In a signal element according to claim 37, wherein more than one fluorescent member is present having different fluorescent light and movement of said member connects the light conducting member with different fluorescent members to obtain different indications.

* * * * *